US009598754B2

(12) United States Patent
Malas

(10) Patent No.: US 9,598,754 B2
(45) Date of Patent: Mar. 21, 2017

(54) METHOD FOR CONTINUOUS HOT-DIP COATING OF METAL STRIPS

(75) Inventor: Akin Malas, Aston (GB)

(73) Assignee: Linde Aktiengesellschaft, Munich (DE)

( * ) Notice: Subject to any disclaimer, the term of this patent is extended or adjusted under 35 U.S.C. 154(b) by 1285 days.

(21) Appl. No.: 12/241,145

(22) Filed: Sep. 30, 2008

(65) Prior Publication Data

US 2009/0098294 A1 Apr. 16, 2009

(30) Foreign Application Priority Data

Oct. 5, 2007 (EP) ..... 07019539

(51) Int. Cl.

| | |
|---|---|
| ***C23C 2/20*** | (2006.01) |
| ***C23C 2/14*** | (2006.01) |
| ***C23C 2/16*** | (2006.01) |
| ***C23C 2/18*** | (2006.01) |
| ***C23C 2/00*** | (2006.01) |
| ***C23C 2/36*** | (2006.01) |

(52) U.S. Cl.

CPC ..... *C23C 2/003* (2013.01); *C23C 2/14* (2013.01); *C23C 2/16* (2013.01); *C23C 2/18* (2013.01); *C23C 2/20* (2013.01); *C23C 2/36* (2013.01)

(58) Field of Classification Search

CPC .... C23C 2/20; C23C 2/14; C23C 2/16; C23C 2/18

USPC ..... 427/430.1, 435, 432, 436, 438

See application file for complete search history.

(56) References Cited

U.S. PATENT DOCUMENTS

| | | | | |
|---|---|---|---|---|
| 3,607,366 | A * | 9/1971 | Kurokawa | 427/349 |
| 3,611,986 | A * | 10/1971 | Pierson | 118/63 |
| 3,917,888 | A * | 11/1975 | Beam et al. | 427/433 |
| 4,330,574 | A | 5/1982 | Pierson et al. | |
| 4,369,211 | A * | 1/1983 | Nitto et al. | 427/349 |
| 4,418,100 | A | 11/1983 | Bedwell et al. | |
| 4,557,952 | A | 12/1985 | Mitch et al. | |
| 4,557,953 | A | 12/1985 | Boston et al. | |
| 4,612,215 | A | 9/1986 | Hennechart et al. | |
| 5,360,641 | A * | 11/1994 | Tu | 427/348 |

FOREIGN PATENT DOCUMENTS

| | | |
|---|---|---|
| EP | 0 122 856 A | 10/1988 |
| JP | 63 109150 A | 5/1988 |
| JP | 63 128160 | 5/1988 |
| JP | 02 015154 A | 1/1990 |

* cited by examiner

*Primary Examiner* — James M Mellott
(74) *Attorney, Agent, or Firm* — Joshua L. Cohen, Esq.

(57) ABSTRACT

The invention provides a method and apparatus for coating a metal product wherein a molten coating is applied to a surface of said metal product and wherein part of said molten coating is wiped off said metal product by an air flow and a nitrogen gas flow.

10 Claims, 1 Drawing Sheet

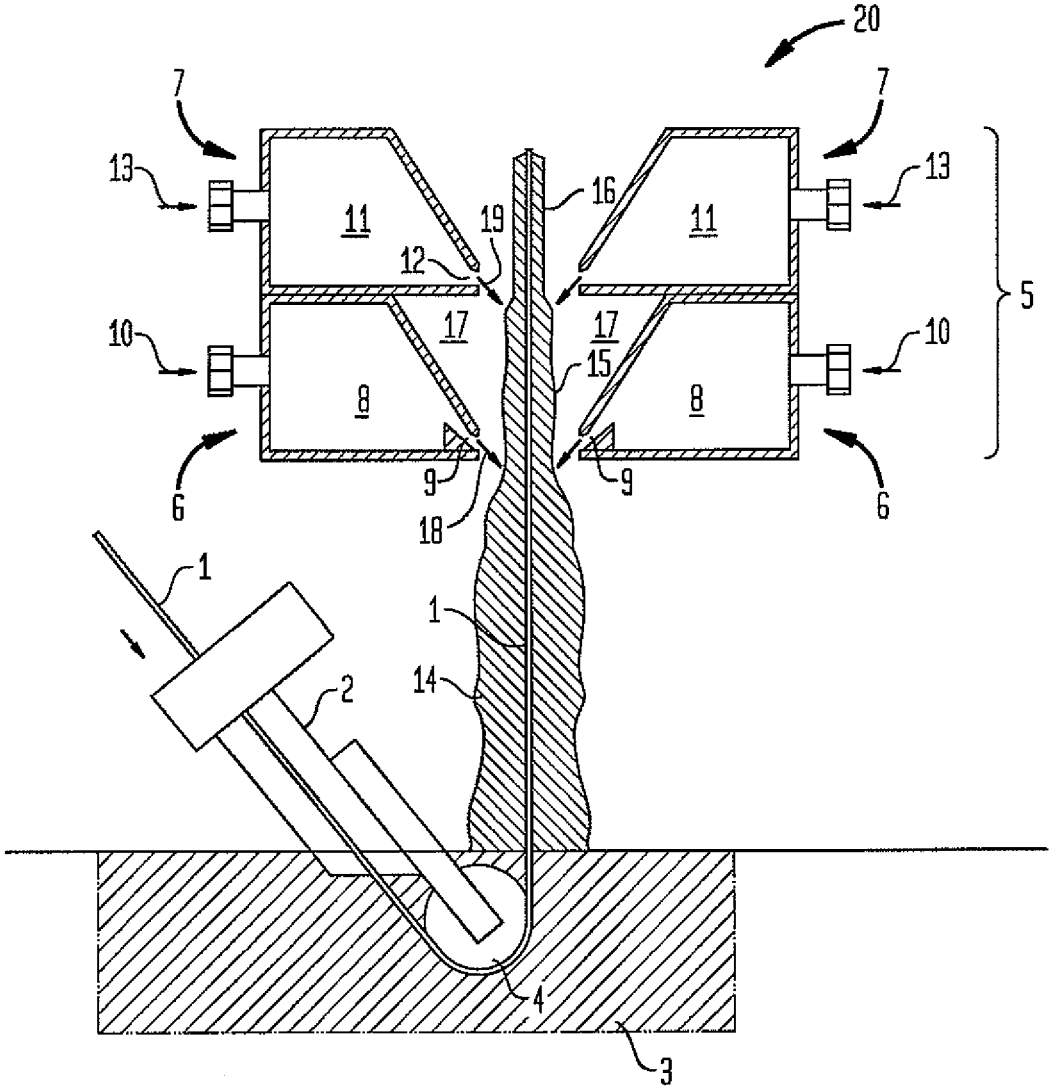
20
7
7
13
13
11
11
19
16
12
5
17
17
10
10
15
8
8
9
9
6
6
18
1
1
14
2
4
3

METHOD FOR CONTINUOUS HOT-DIP COATING OF METAL STRIPS

The invention relates to a method for coating a product, in particular a metal product, wherein a molten coating is applied to a surface of said product and wherein part of said molten coating is wiped off said product by a gas flow directed to said product. Further, the invention relates to an apparatus for coating a product, in particular a metal product, having a coating section wherein a molten coating is applied to a surface of said product, and a control section having a gas knife for wiping off part of said molten coating from said product.

Continuous hot-dip galvanizing of metal sheets is a well-known technique, which involves the application of a molten coating onto the surface of a metal sheet in a continuous process. The metal sheet is passed through a bath of a molten metal. In the bath the surface of the metal sheet reacts with the molten metal to bond the coating onto the sheet surface. When the metal sheets emerge from the metal bath excess liquid metal is bonded to the surface, too.

In a subsequent control section the coating thickness is controlled. This thickness control is achieved by a gas wiping process. Gas nozzles deliver low-pressure, high-volume air streams on the surface of the metal sheet to wipe off surplus molten metal pulled from the molten metal bath. Since the gas nozzles "cut off" excess coating material they are often referred to as "gas knives".

In the following the term "gas knife" shall mean a device for delivering a gas onto or along the surface, in order to wipe off surplus coating material. The terms "air knife" and "nitrogen knife" accordingly refer to devices for delivering air or nitrogen for gas wiping purposes.

Some of the steel manufacturers use nitrogen instead of air as the wiping gas in the steel galvanizing process. The use of nitrogen has the advantage that a coating with improved surface quality is achieved due to the inertness of nitrogen. But since the flow pattern is normally not changed compared to the air-wiping technology, that is low-pressure, high volume flows of nitrogen are directed to the metal sheet, the related gas costs are relative high.

OBJECTS OF THE INVENTION

It is an object of the invention to propose a method and an apparatus for gas-wiping with increased flexibility.

This object is achieved by a method and apparatus for coating a product wherein a molten coating is applied to a surface of said product and wherein part of said molten coating is wiped off said product by a gas flow directed to said product, which is characterized in that a first gas flow and a second gas flow are subsequently directed to said product.

According to the invention at least two gas flows are used to wipe off any excess molten coating. The first and the second gas flow are directed one after the other to the product. It is also possible to have more than two gas flows subsequently directed to the product.

BRIEF DESCRIPTION OF THE DRAWING

The invention as well as further details of the invention will now be described with reference to the attached drawing. The FIGURE schematically shows an arrangement for coating a steel sheet according to the invention.

DETAILED DESCRIPTION OF THE INVENTION

The invention will be described with reference to coating a metal product. However, those skilled in the art will understand that the following is not limited to metal products but is applicable to the coating of non-metallic products, too.

The first gas flow and the second gas flow preferably differ in at least one of the parameters velocity, pressure, volume, flow pattern, temperature and/or composition.

For example, at first a gas flow with a high velocity and/or a high pressure is directed to the product, preferably a metal product, to wipe off the major part of excess coating and then a gas flow with a lower velocity and/or a lower pressure is used to achieve the desired final surface quality. The first gas and the second gas might be the same gas, for example nitrogen, or different gases, such as air and nitrogen.

Instead of or additional to using different velocities or different pressures for the first and the second gas flow, it is also possible to have different amounts of gas blown onto the product by the first and the second gas knife, respectively.

Another parameter which can be used to positively affect the result of the wiping process is the temperature of the wiping gas. Thus, in a preferred embodiment different temperatures for the first and the second gas flow are used.

In still another preferred embodiment different gases or different gas compositions are used for the first and the second gas flow. For example, the first gas knife is provided with air, the second gas knife is supplied with nitrogen. As another example, nitrogen and argon are supplied to the first and the second gas knife, respectively.

The wiping gas is preferably selected from the group of: air, nitrogen, argon, helium, hydrogen, carbon dioxide or carbon monoxide.

It is preferred to use an inert gas for the first gas flow and/or for the second gas flow. Preferred inert gases are nitrogen and argon.

According to a preferred embodiment a flow of air and a flow of nitrogen are directed to the product. According to this embodiment it is not necessary to carry out the whole gas wiping process with nitrogen in order to achieve a coating with a high quality surface. The inventors have shown that a combination of air knife technology and nitrogen knife technology that is wiping with air and with nitrogen provides a coating with improved surface quality comparable to that achieved by nitrogen knife technology. But the gas consumption costs are essentially reduced due to the reduced amount of nitrogen used.

The air flow and the nitrogen flow are directed to said product one after the other. It is in particular preferred to first use an air flow for wiping off excess molten coating and to subsequently direct a nitrogen flow to said product. The idea is to first reduce the coating with an air flow to a particular level and then complete the wiping with nitrogen. Due to its inertness the nitrogen is used to finish the final molten coating in order to achieve the desired surface quality. Thus, without any loss of surface quality the inventive method reduces the required nitrogen volume and the related gas consumption costs compared to the use of pure nitrogen knives.

In order to achieve a specific surface roughness or a specific surface quality or to change the surface solidification behaviour it might be advantageous to use the air flow first and then the nitrogen flow. Further, to achieve a maximum flexibility to change the surface properties of the coating it might also be helpful to apply the air flow and the nitrogen flow at the same time.

The ratio of the first gas flow to the second gas flow is preferably between 1 to 99 and 99 to 1. It is in particular preferred to set the ratio of the first and the second gas flow, for example the ratio of air to nitrogen, between 1:4 and 4:1, even more preferred between 1:3 and 3:1.

According to an especially preferred embodiment of the invention the nitrogen consumption is between 30% and 70%, preferably between 40% and 60%, of the nitrogen consumption of a pure nitrogen knife system with the remainder preferably being air. For example, 40% of the total gas used for gas wiping is nitrogen and 60% of the total gas is air. Thus, the nitrogen consumption is reduced to 40% of the consumption of a pure nitrogen gas wiping system.

The invention is preferably aimed at coating elongated metal products, in particular metal strips, metal sheets or metal wires, for example steel sheets or steel strips, which are continuously passed through a coating section where a molten coating is applied to a surface of the metal product. The metal strip or metal sheet or in general the elongated metal product is transported through a coating bath where coating material from the coating bath is bonded to the surface of the metal product. When the elongated metal product exits the bath it drags out more coating material than needed for the coating. Therefore, a first and a second gas flow, for example air and nitrogen, are blown onto the surface to wipe off excess coating material and to achieve the desired thickness.

It is advantageous to pass the coated elongated metal product continuously along a first and a second gas knife which blow a first and a second, respectively, gas flow onto or along the surface of the passing metal product.

Preferably a metal coating is applied to the product. Preferably the coating which is applied to the product, especially a metal product, comprises one or more metals or composites of the group of zinc, aluminium, silicon.

In particular, the invention is directed to galvanizing a product, and even more preferred to galvanizing metal sheets or metal strips, in particular steel sheets or steel strips. However, the inventive method can also be used for the application of other coating materials to a metal product by hot-dip coating that is by dipping the metal product into a bath of coating material.

When coating an elongated product as described above the amount of excess coating material which is dragged out of the coating bath depends on the speed the metal product exits the bath. The higher the speed, the more coating material is dragged out of the bath. The inventive method works well at speeds of the product between 1 m/min and 300 m/min, that is it fits quite well into the speed range of standard hot-dip coating systems.

The inventive apparatus for coating a product includes a coating section wherein a molten coating is applied to a surface of said product, especially a metal product, and a control section wherein said control section comprises a first gas knife for wiping off part of said molten coating from said product, and wherein said apparatus is characterized in that said control section comprises a second gas knife for wiping off part of said molten coating from said product.

The inventive apparatus allows using different gases and/or different gas flows for controlling the coating thickness on said product. The first and the second gas knife can be provided with any type of gas. The invention gives flexibility to set the first and the second gas flow consumption in such a way that the required thickness and the required surface quality of the coating can be achieved.

For example, the inventive apparatus can operate with air consumption between 0% and 100% and nitrogen consumption between 0% and 100%. Thus, it is possible to work with air only, with nitrogen only or with both air and nitrogen at any desired relation. When the surface requirements are higher the nitrogen to air ratio will be increased and, on the other hand, when the quality requirements are lower the nitrogen to air ratio is decreased in order to reduce the nitrogen consumption costs.

It is advantageous that the control section comprises a transport path along which said product is passed and wherein said first gas knife and said second gas knife are arranged in series along said transport path and wherein said second gas knife is located downstream of said first gas knife. The term "downstream" refers to the transport direction of the product. After leaving the coating bath the product is passed along the transport path through the control section. In the control section the product is first subjected to a first gas flow, preferably an air flow provided by the first gas knife, an air knife, and then subjected to a second gas flow, preferably an inert gas flow such as a nitrogen flow, delivered through the second gas knife.

The FIGURE shows an apparatus 20 for galvanizing a steel strip 1. The steel strip 1 is transported through a snout 2 into a coating or galvanizing bath 3 of molten zinc. Within the bath 3 molten zinc is bonded to the steel surface. The steel strip 1 is deflected by a sink roll 4 and exits the coating bath 3 in a vertical direction.

Above the coating bath 3 there is a control section 5 which comprises an air knife 6 and a nitrogen knife 7. Air knife 6 comprises a chamber 8 with a slot opening 9. Chamber 8 is connected to an air supply 10. Nitrogen knife 7 comprises a chamber 11 with a slot opening 12 and a nitrogen supply 13.

In operation the steel strip 1 is passed at a high speed of for example about 150 m/min through the coating bath 3 and through control section 5. In control section 5 any excess zinc 14 which has been dragged off the coating bath 3 is blown off the steel strip 1 by air and nitrogen as described below.

Air knife 6 is supplied with pressurized air which is then blown out through the slot opening 9 onto the surface of the coated steel strip 1. The resulting air jet 18 acts as a knife and wipes off excess molten zinc from the surface of the steel strip 1. The molten zinc which has been stripped off the steel strip 1 flows back into the coating bath 3.

Above the slot opening 9 of air knife 6 the coating thickness has been reduced to a first particular level 15. Then the coating 15 is subjected to a nitrogen jet 19 which completes the wiping of excess zinc. Further, since nitrogen is an inert gas a coating 16 with a high quality surface is created.

In order to prevent air from going up from the air knife 6 to the nitrogen knife 7, the air knife 6 and the nitrogen knife 7 are arranged in such a way that a turbulence zone 17 is created between them. The turbulence zone 17 acts as a buffer and stops air from going up into the region of the outlet 12 of nitrogen knife 7. Thus, the final reduction of the coating thickness by nitrogen knife 7 is carried out in an atmosphere essentially consisting of nitrogen.

Pressure and volume of the air supplied to the air knife 6 and of the nitrogen supplied to the nitrogen knife 7 are controlled depending on the speed of the steel strip, the desired thickness and quality of the coating, and/or the type of coating material. Further parameters which might be used to control pressure and volume of the air are the height of the air knife 6 above the bath 3, the distance of the air knife 6 from the passing steel strip 1, the angle of air knife 6, or the size of slot opening 9.

Depending on the desired surface quality requirements the ratio of air flow 18 to nitrogen flow 19 may vary between 1:5 and 5:1.

Preferably the nitrogen consumption is reduced to 30% to 70% of a pure nitrogen wiping system. In other words, only 30% to 70% of the whole gas directed to the steel strip 1 is nitrogen or, the other way round, between 70% and 30% of the nitrogen used in a pure nitrogen wiping system are replaced by air.

It will be understood that the embodiments described above are merely exemplary and that a person skilled in the art may make many variations and modifications without departing from the spirit and scope of the invention. All such variations and modifications are intended to be included within the present invention as described herein.

What is claimed is:

1. A method for coating a product, comprising:

applying a molten coating to a surface of the product; and removing an excess portion of the molten coating from said product, said removing comprising:

directing an air flow having a first composition to the product for removing a major part of said excess portion of the molten coating from said product, and directing an inert gas flow having a second composition different than the first composition to the product after the directing the air flow for removing a second portion of said excess portion from said product.

2. The method according to claim 1, wherein said air flow and said inert gas flow differ from each other in at least one of velocity, pressure, volume, flow pattern and temperature.

3. The method according to claim 1, further comprising continuously passing the product through the molten coating for applying the molten coating to the surface of the product.

4. The method according to claim 3, wherein the applying the molten coating comprises continuously passing the product through a bath of molten coating material.

5. The method according to claim 1, wherein the molten coating comprises a metal coating applied to said product.

6. The method according to claim 5, wherein said product is galvanized.

7. The method according to claim 1, further comprising passing said product through said molten coating at a speed from between 1 m/min and 300 m/min.

8. The method according to claim 1, wherein the air flow and the inert gas flow are directed to said product, and an air to inert gas ratio is from between 1:4 and 4:1.

9. The method according to claim 1, wherein the product comprises an elongated metal product selected from the group consisting of a metal strip, a metal sheet, and a metal wire.

10. The method according to claim 1, wherein the inert gas flow comprises a gas selected from the group consisting of nitrogen and argon.

* * * * *